United States Patent [19]

Roffler

[11] 4,016,997

[45] Apr. 12, 1977

[54] VESSEL FOR CONVEYING A LIQUID/GAS MIXTURE

[75] Inventor: Josua Roffler, Winterthur, Switzerland

[73] Assignee: Sulzer Brothers Limited, Winterthur, Switzerland

[22] Filed: Mar. 7, 1975

[21] Appl. No.: 556,461

[30] Foreign Application Priority Data

Mar. 8, 1974 Switzerland ..... 3267/74

[52] U.S. Cl. ..... 220/10; 138/148; 220/15; 220/71

[51] Int. Cl.[2] ..... B65D 7/22; B65D 7/49

[58] Field of Search ..... 138/41, 131, 139, 142, 138/143, 147, 148, 149; 123/141; 55/435, 487, 462; 220/10, 12, 15, 63 R, 71, 84

[56] References Cited

UNITED STATES PATENTS

| | | | |
|---|---|---|---|
| 153,257 | 7/1874 | Irons et al. | 138/148 X |
| 575,526 | 1/1897 | McIntyre | 220/63 R |
| 720,003 | 2/1903 | Curtiss | 138/148 X |
| 840,293 | 1/1907 | Bocquet | 138/143 |
| 961,423 | 6/1910 | Sturtevant et al. | 123/141 |
| 1,223,101 | 4/1917 | Pacziga | 55/186 |
| 1,359,314 | 11/1920 | Barto | 123/141 X |
| 2,633,873 | 4/1953 | Stines | 138/142 |
| 2,744,863 | 5/1956 | Andrus | 220/63 R X |
| 2,812,034 | 11/1957 | McKelvey, Jr. | 55/186 |
| 3,523,577 | 8/1970 | Milton | 165/180 X |
| 3,877,985 | 4/1975 | Wonderland et al. | 138/41 X |
| 3,886,980 | 6/1975 | Elson | 138/143 X |

*Primary Examiner*—William Price
*Assistant Examiner*—Stephen Marcus
*Attorney, Agent, or Firm*—Kenyon & Kenyon Reilly Carr & Chapin

[57] ABSTRACT

The vessel wall is lined with one or more sieve-like linings formed of wire mesh, expanded metal, perforated plate or the like to inhibit corrosion of the vessel wall. At least one of the linings is formed with apertures which are of a mean diameter smaller than the mean diameter of the drops in the conveyed liquid/gas mixture to cause a deceleration of the drops before impinging on the vessel wall as well as a reduction in the size of the drops.

10 Claims, 7 Drawing Figures

VESSEL FOR CONVEYING A LIQUID/GAS MIXTURE

This invention relates to a vessel for conveying a liquid/gas mixture.

As is known, the various structures such as pipes, vessels and the like, which convey liquid/gas mixtures have exposed walls which are attacked by the impingement of drops from the mixtures. For example, if the inner wall of a vessel which conveys a steam/water mixture is made of carbon steel, the wall is initially roughened by continued impingement of wet steam and thereafter pitted. The pitting is continously enlarged until the limit of reliability is achieved. Generally, not all zones of the vessel become equally endangered. The most endangered are the wall zones that define the parts of the vessel in which the liquid/gas mixture is very turbulent, for example, where the mixture flows out of a conduit connected to the vessel.

Accordingly, it is an object of the invention to eliminate corrosion in the zones of a vessel wall endangered by erosion-corrosion from a liquid/gas mixture.

It is another object of the invention to provide a simple structure for eliminating corrosion on the interior walls of a liquid/gas mixture conveying vessel.

Briefly, the invention provides a vessel or any like structure having an interior wall defining at least a portion of a flow path for conveying a liquid/gas mixture with at least one metallic sieve-like lining disposed adjacent the wall to protect the wall from the mixture. The lining preferably consists of a woven-wire mesh but may also be made of a perforated sheet of metal, or a plate of expanded metal or metal mesh.

In order to secure a lining to the vessel wall, a plurality of bolts are mounted on the vessel wall and pass through the lining. In this case, the lining is impaled on the bolts when mounted in place. In order to further support the lining, at least some of the bolts have a hole passing therethrough on a side of the lining opposite the wall and a wire is passed through these holes from bolt-to-bolt.

The lining may be disposed flush against the vessel wall or may be spaced from the vessel wall. In the latter case, one or more washers may be disposed on the bolts to act as spacers the lining from the vessel wall.

The sieve-like nature of the lining is such as to create apertures through the lining. Where a pair of linings having differently sized apertures are used, the linings may be offset relative to each other with the lining having the larger apertures facing the vessel wall in order to decrease the effective width of the apertures. Three linings may also be used with different sized apertures with the lining having the smallest apertures set between the other two linings. In any event, the mean diameter of the apertures of the lining with the smallest apertures is preferably smaller than the mean diameter of the drops in the liquid/gas mixture.

These and other objects and advantages of the invention will become more apparent from the following detailed description and appended claims taken in conjunction with the accompanying drawings in which:

FIG. 1*a* illustrates a schematic cross-sectional view of a lining spaced from a vessel wall in accordance with the invention;

FIG. 1*b* illustrates a schematic front view of the lining and wall section of FIG. 1*a*;

Figure 5:
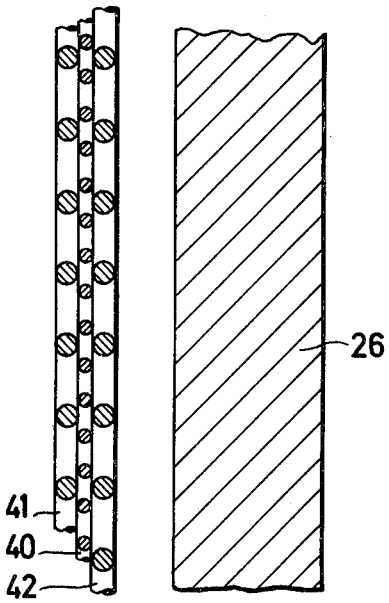
Figure 4:
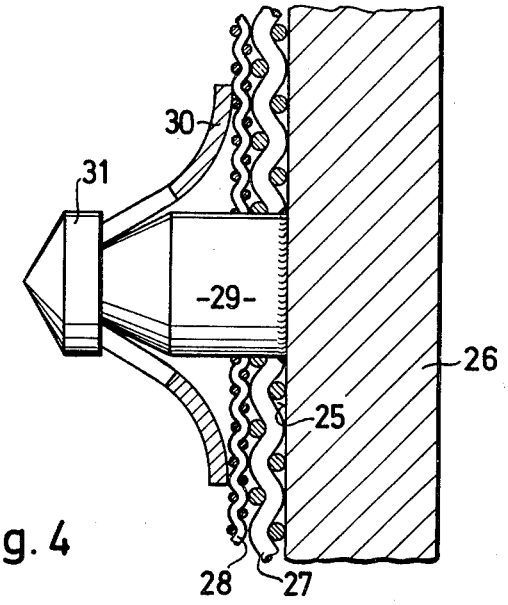
FIG. 4 illustrates a view of a pair of linings mounted on a vessel wall in accordance with the invention.
Figure 4A:
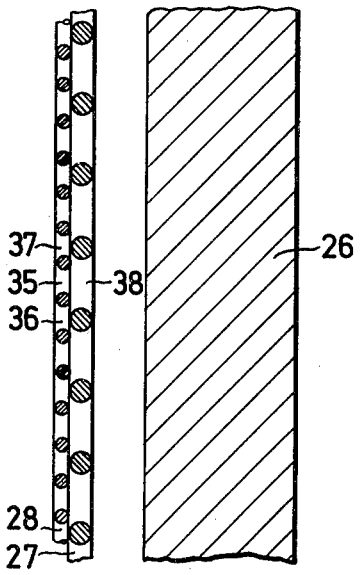

FIG. 4*a* illustrates a schematic side view of the linings and vessel of FIG. 4; and FIG. 5 illustrates a schematic side view of three linings mounted adjacent a vessel wall in accordance with the invention.

Figure 1A:
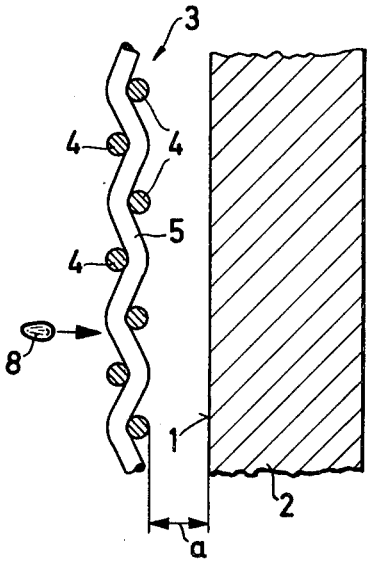
Figure 1B:
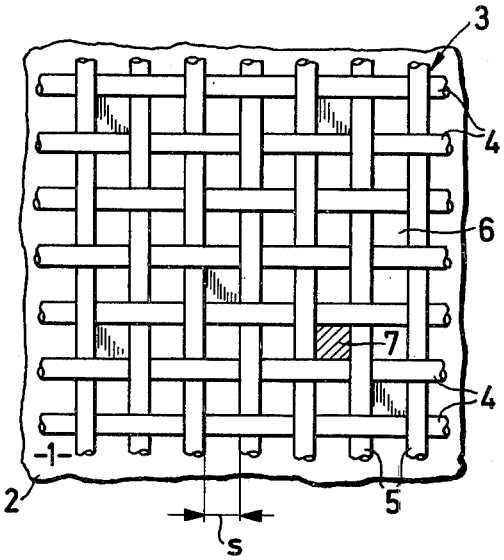

Referring to FIGS. 1*a* and 1*b*, a vessel 2 for conveying a liquid/gas mixture has an interior wall 1 which defines at least a portion of the flow path for the mixture. The wall 1 is situated in a region or zone of the vessel subject to erosion-corrosion, for example, where there is wet steam. This wall 1 is lined with a metallic sieve-like lining 3 which serves to protect the wall 1 from the liquid/gas mixture. The lining 3, as indicated, is made of a woven-mesh consisting of crossed wires 4, 5 which define apertures or mesh 6 of predetermined size *s*. As shown in FIG. 1*a*, the lining 3 is spaced from the wall 1*a* distance *a* although, the lining 3 may also be flush against the wall 1.

In use, because of the wet steam atmosphere, the lining 3 is enveloped in a layer of water. Thereafter, as the drops 8 of water of the saturated steam, only one of which is shown in FIG. 1*a*, move at high speed toward the wall 1, the drops impinge on the lining 3. Upon passing into the water layer, the speed of each drop 8 becomes greatly decelerated so that the drop encounters the vessel wall 1 only at low speed. Thus, the drops are unable to produce erosion of the wall surface. In addition, as the drops 8 pass through the lining 3, the drops are reduced in size with a part of the drops remaining behind in the water layer on the lining 3. The drops thus contribute to the maintenance of the water layer. Any excess water flows down the vessel wall 1 and on the front and rear faces of the lining 3.

Although the drops 8 break-up on the lining 3, no damage occurs to the lining 3. If, however, the lining 3 is significantly eroded over a long period of use, replacement is required.

The size of the apertures 6, that is, the mesh width or mean diameter, is determined by the mean size of the drops 8 and is preferably smaller than the mean size of the drops 8. The apertures are sized such as to permit formation of a layer of water on the lining 3 during conveyance of the wet system.

Figure 2:
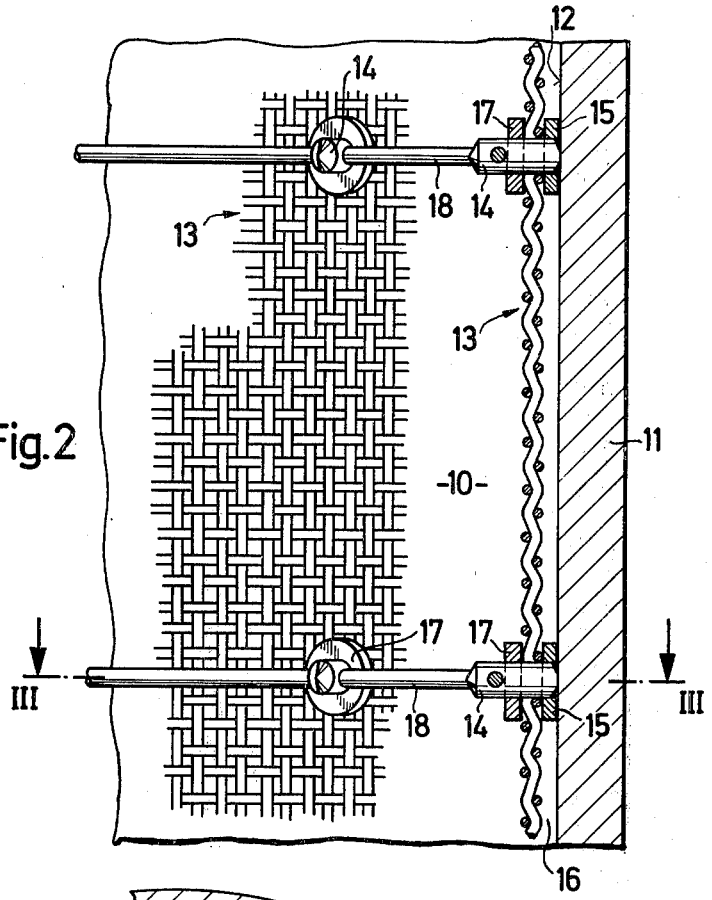
FIG. 2 illustrates a partial sectional view of a vessel wall lined in accordance with the invention.
Figure 3:
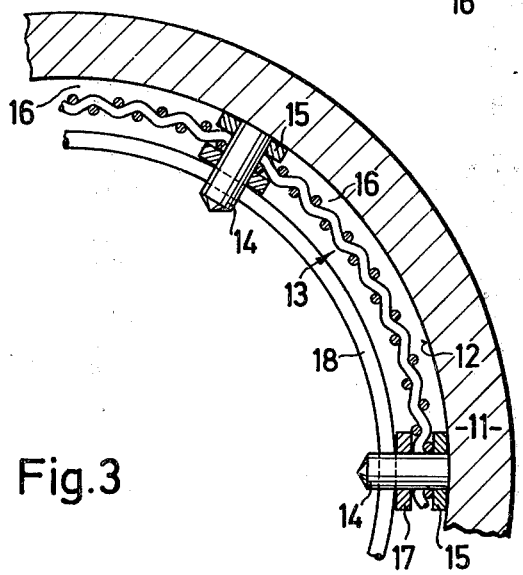
FIG. 3 illustrates a view taken on line III—III of FIG. 2.

Referring to FIGS. 2 and 3, a vessel having an erosion-endangered region 10 defined by a cylindrical wall 11 has a wire-mesh lining 13, as above, of non-rusting steel mounted in spaced relation adjacent to the interior surface of the wall 11. In order to secure the lining 13 in place, a plurality of bolts 14 are mounted as by welding on the wall surface 12 at uniform spacings. The lining 13 is, in turn, impaled on these bolts 14 so that the bolts 14 pass through the apertures in the lining 13. In addition, a washer 15 is disposed on each bolt 14 to space the lining 13 from the wall 11 so that a free space 16 is defined between the lining 13 and wall 11. A second washer 17 is also mounted on each bolt 14 and each bolt 14 is provided with a transverse hole through which a respective wire 18 passes. In this way, the lining 13 is further supported by the wires 18 while the washers 17 space the lining 13 from the holes through which the wires 18 pass.

Referring to FIG. 4, the interior surface 25 of a vessel wall 26 may also be covered by a pair of wire-mesh linings 27, 28. As shown, the outer lining 27 rests against the wall 26 as well as against the inner lining 28. Also, a plurality of bolts 29, only one of which is shown passes through the two linings 27, 28 and a spring element 30 is mounted on each bolt 29 to hold the linings 27, 28 together against the wall 26. Each spring element 30 is part of a press button 31 placed on a spherical end (not shown) of a bolt 29.

As shown in FIGS. 4 and 4*b*, the apertures or mesh width of the outer lining 27 are of larger size than the apertures of the inner lining 28. Also, both linings 27, 28 are offset from each other so that the aperture 35 and part of two adjacent apertures 36, 37 of the inner lining 28 fall within an aperture 38 of the outer lining 27. The outer lining 27 may be woven of thicker wires than the inner lining 28 so as to serve as a support for the finer and more flexible lining 28. Alternatively, the outer lining 28 may be made of an expanded metal plate of suitable thickness.

Both woven wire linings 27, 28 may, of course, have the same mesh width and be offset from one another so that the resultant effective mesh-width is one-half that of a single mesh or aperture.

Referring to FIG. 5, three linings 40, 41, 42 may be mounted adjacent a vessel wall. In this case, the middle lining 40 which is set between the other two linings 41, 42 is made with a finer mesh, i.e. the apertures are smaller than in the other two linings 41, 42. In this way, the more flexible middle lining 40 is supported on both sides.

It is to be noted that the above description refers specifically to a wet steam; however, the lining or linings may be used to line vessels for other liquid/gas mixtures.

What is claimed is:

1. In combination with a metallic vessel having an interior wall defining at least a portion of a flow path for conveying wet steam from an inlet toward an outlet of said vessel, at least one metallic wire mesh having disposed adjacent said wall to protect said wall from wet steam in said path, said lining being disposed at least in a region where said wall would be subject to cavitation-erosion by the wet steam flowing along the side of said lining opposite to that side of said lining facing said wall, said lining having apertures therein with the mean diameter of said apertures being smaller than the mean diameter of drops in the conveyed wet steam, said apertures being such as to permit formation of a layer of water on said lining during conveyance of the wet steam.

2. The combination as set forth in claim 1 which includes a pair of said linings, each said lining having apertures therein of different size from the apertures in the other lining, and said lining having the larger apertures facing said wall.

3. The combination as set forth in claim 1 which further includes a plurality of bolts mounted on said wall and passing through said lining to secure said lining to said wall.

4. The combination as set forth in claim 3 wherein at least some of said bolts have a hole passing therethrough on a side of said lining opposite said wall and which further includes at least one wire passing through said holes of at least some of said bolts to support said lining.

5. The combination as set forth in claim 1 wherein said lining consists of a woven-wire mesh.

6. The combination as set forth in claim 5 wherein said mesh is made of non-rusting steel.

7. The combination as set forth in claim 1 which includes three of said linings, each said lining having apertures therein of different size from the apertures in the other linings, and said lining having the smallest apertures being disposed between the other linings.

8. The combination as set forth in claim 7 wherein said apertures of said lining having the smallest apertures are of a mean diameter smaller than the mean diameter of drops in the conveyed liquid/gas mixture.

9. In combination with a vessel having an interior wall defining at least a portion of flow path for conveying a liquid/gas mixture, at least one metallic sieve-like lining disposed adjacent said wall to protect said wall from a liquid/gas mixture in said path and a plurality of bolts mounted on said wall and passing through said lining to secure said lining to said wall, at least some of said bolts having a hole passing therethrough on a side of said lining opposite said wall and which further includes at least one wire passing through said holes of at least some of said bolts to support said lining.

10. The combination as set forth in claim 9 which further includes at least one washer on at least some of said bolts for spacing said lining from said wall.

* * * * *